US007364777B1

(12) United States Patent
Ansari

(10) Patent No.: US 7,364,777 B1
(45) Date of Patent: Apr. 29, 2008

(54) HEAT-TRANSFER LABEL ASSEMBLY AND METHOD OF USING THE SAME

(75) Inventor: Saifuddin M. Ansari, Ashland, MA (US)

(73) Assignee: Multi-Color Corporation, Sharonville, OH (US)

( * ) Notice: Subject to any disclaimer, the term of this patent is extended or adjusted under 35 U.S.C. 154(b) by 269 days.

(21) Appl. No.: 10/920,523

(22) Filed: Aug. 18, 2004

(51) Int. Cl.
*B41M 5/40* (2006.01)

(52) U.S. Cl. ..... 428/32.69; 428/32.75; 428/32.77; 428/32.81; 428/32.85; 428/480; 428/914

(58) Field of Classification Search ..... 428/32.69, 428/32.75, 32.77, 32.81, 32.85, 480, 914
See application file for complete search history.

(56) References Cited

U.S. PATENT DOCUMENTS

| | | | |
|---|---|---|---|
| 3,616,015 | A | 10/1971 | Kingston |
| 3,907,974 | A | 9/1975 | Smith |
| 4,321,185 | A | 3/1982 | Benitez |
| 4,548,857 | A | 10/1985 | Galante |
| 4,555,436 | A | 11/1985 | Geurtsen et al. |
| 4,927,709 | A | 5/1990 | Parker et al. |
| 4,935,300 | A | 6/1990 | Parker et al. |
| 5,448,282 | A | 9/1995 | Imai et al. |
| 5,607,896 | A | 3/1997 | Hutt |
| 5,800,656 | A | 9/1998 | Geurtsen et al. |
| 5,891,520 | A | 4/1999 | Makar et al. |
| 5,919,834 | A | 7/1999 | Downs et al. |
| 5,968,689 | A | 10/1999 | Torikoshi et al. |
| 6,004,419 | A | 12/1999 | Torii |
| 6,033,763 | A | 3/2000 | Laprade et al. |
| 6,042,676 | A | 3/2000 | Stein |
| 6,083,620 | A | 7/2000 | LaPrade et al. |
| 6,096,408 | A | 8/2000 | Laprade et al. |
| 6,099,944 | A | 8/2000 | Laprade et al. |
| 6,344,269 | B1 | 2/2002 | Makar et al. |
| 6,376,069 | B1 | 4/2002 | Bilodeau et al. |
| 6,391,415 | B1 | 5/2002 | McCurry et al. |
| 6,537,651 | B2 | 3/2003 | Geurtsen et al. |
| 6,902,641 | B1 | 6/2005 | Patel et al. |
| 2003/0134110 | A1 | 7/2003 | Laprade |

OTHER PUBLICATIONS

Technical literature for CYCAT 4040 catalyst, published by Cytec Industries, Inc., West Paterson, NJ, before the filing of the present application.
Technical literature for CYMEL 303 crosslinking agent, published by Cytec Industries, Inc., West Paterson, NJ, before the filing of the present application.
ViTEL 2000-3000 Technical Guide, Shell Chemical Company, Akron, OH, published before the filing of the present application.

*Primary Examiner*—Betelhem Shewareged
(74) *Attorney, Agent, or Firm*—Kriegsman & Kriegsman

(57) ABSTRACT

A heat-transfer label assembly and method of using the same. In one embodiment, the assembly is particularly well-suited for decorating flexible plastic articles and comprises a paper substrate overcoated with a layer of polyethylene, a skim coat of wax overcoated onto the polyethylene layer, and one or more spaced apart, heat-transfer labels printed onto the skim coat. Each label is bondable to the article when activated by heat and consists of one or more ink design layers, each ink design layer comprising a mixture of polyester resins, a pigment, a cross-linking resin and a catalyst. When initiated by label transfer, the catalyst causes the cross-linking resin to partially cross-link the polyester resin to an extent that the label is endowed with protective properties while still retaining sufficient flexibility to avoid cracking when the article is flexed.

28 Claims, 1 Drawing Sheet

HEAT-TRANSFER LABEL ASSEMBLY AND METHOD OF USING THE SAME

BACKGROUND OF THE INVENTION

The present invention relates generally to heat-transfer label assemblies and more particularly to a novel heat-transfer label assembly and to a method of using the same.

Heat-transfer labels are implements commonly used to decorate and/or to label commercial articles, such as, and without limitation to, containers for beverages (including alcoholic beverages, such as beer), essential oils, detergents, adverse chemicals, as well as health and beauty aids. As can readily be appreciated, heat-transfer labels are desirably resistant to abrasion and chemical effects in order to avoid a loss of label information and desirably possess good adhesion to the articles to which they are affixed. Heat-transfer labels are typically constructed as part of a heat-transfer label assembly, with one or more heat-transfer labels printed on a removable carrier web.

One of the earliest types of heat-transfer label assemblies is described in U.S. Pat. No. 3,616,015, inventor Kingston, which issued October, 1971, and which is incorporated herein by reference. In the aforementioned patent, there is disclosed a heat-transfer label assembly adapted for labeling plastic objects, the heat-transfer label assembly comprising a paper sheet or web, a wax release layer affixed to the paper sheet, and an ink design layer printed on the wax release layer. In the heat-transfer labeling process, the label-carrying web is subjected to heat, and the label is pressed onto a plastic article with the ink design layer making direct contact with the plastic article. As the paper sheet is subjected to heat, the wax layer begins to melt. This enables the paper sheet to be released from the ink design layer, with a portion of the wax layer being transferred with the ink design layer onto the plastic article and with a portion of the wax layer remaining with the paper sheet. After transfer of the design to the plastic article, the paper sheet is immediately removed, leaving the design firmly affixed to the plastic article and the wax transferred therewith exposed to the environment. The wax layer is thus intended to serve two purposes: (1) to provide release of the ink design from the web upon application of heat to the web and (2) to form a protective layer over the transferred ink design. After transfer of the label to the article, the transferred wax release layer is typically subjected to a post-flaming or post-heating technique which involves subjecting the transferred wax release layer to jets of high temperature gas either as direct gas flames or as hot air jets to produce wax surface temperatures of about 300° F. to 400° F. for a period of time sufficient to remelt the transferred wax. This remelting of the transferred wax is performed to enhance the optical clarity of the wax protective layer (thereby enabling the ink design layer therebeneath to be better observed) and to enhance the protective properties of the transferred wax release.

Unfortunately, despite the aforementioned post-flaming step, the transferred wax layer is often perceptible on clear and/or dark-colored objects.

Consequently, a great deal of effort has been expended in replacing or obviating the need for a wax release layer. One type of heat-transfer label assembly that does not include a wax release layer is exemplified by U.S. Pat. No. 4,935,300, inventors Parker et al., which issued Jun. 19, 1990, and which is incorporated herein by reference. In the aforementioned Parker patent, the label assembly, which is said to be particularly well-suited for use on high density polyethylene, polypropylene, polystyrene, polyvinylchloride and polyethylene terephthalate surfaces or containers, comprises a paper carrier web which is overcoated with a layer of thermoplastic polyethylene. A protective lacquer layer comprising a polyester resin and a relatively small amount of a nondrying oil is printed onto the polyethylene layer. An ink design layer comprising a resinous binder base selected from the group consisting of polyvinylchloride, acrylics, polyamides and nitrocellulose is then printed onto the protective lacquer layer. A heat-activatable adhesive layer comprising a thermoplastic polyamide adhesive is then printed onto the ink design layer.

Although the above-described Parker label assembly substantially reduces the wax-related effects discussed previously, said label assembly does not quite possess the same release characteristics of heat-transfer label assemblies containing a wax release layer. In fact, when put to commercial use, the polyethylene release layer of the Parker label assembly was found to become adhesive when subjected to the types of elevated temperatures typically encountered during label transfer. Accordingly, another type of heat-transfer label assembly differs from the Parker heat-transfer label assembly in that a very thin layer or "skim coat" of carnauba wax is interposed between the polyethylene release layer and the protective lacquer layer to improve the release of the protective lacquer from the polyethylene-coated carrier web. The thickness of the skim coat corresponds to approximately 0.1-0.4 lbs. of the wax spread onto about 3000 square feet of the polyethylene release layer. The aforementioned "skim coat-containing" heat-transfer label assembly also differs from the Parker label assembly in that the heat-activatable adhesive of the "skim coat" label assembly is printed over the entirety of the ink and protective lacquer layers, with the peripheral edges of the adhesive layer in direct contact with the wax skim coat.

An example of a "skim coat-containing" heat-transfer label assembly of the type described above is disclosed in U.S. Pat. No. 6,042,676, inventor Stein, which issued Mar. 28, 2000, and which is incorporated herein by reference. According to the aforementioned patent, a label assembly is provided that is said to be suitable for use on silane-treated glass containers, refundable polyethylene terephthalate (PET) containers, and the like. According to one embodiment, the label includes a sheet of paper overcoated with a release layer of polyethylene. A skim coat of wax is overcoated onto the polyethylene-coated paper. A protective lacquer layer comprising a polyester, polyester/vinyl or polyester/vinyl with wax lacquer is printed onto the skim coat. An ink design layer comprising one or more polyester inks is printed onto the protective lacquer layer. An adhesive layer comprising a polyester, polyester/vinyl or polyester/vinyl with wax adhesive is printed onto the ink design layer, onto any exposed portions of the protective lacquer layer and onto the skim coat in an area surrounding the protective lacquer layer.

Examples of other "skim coat-containing" heat-transfer label assemblies are disclosed in the following U.S. patents, all of which are incorporated herein by reference: U.S. Pat. No. 5,800,656, inventors Geurtsen et al., issued Sep. 1, 1998; U.S. Pat. No. 6,033,763, inventors Laprade et al., issued Mar. 7, 2000; U.S. Pat. No. 6,083,620, inventors Laprade et al., issued Jul. 4, 2000; U.S. Pat. No. 6,096,408, inventors Laprade et al., issued Aug. 1, 2000; and U.S. Pat. No. 6,099,944, inventors Laprade et al., issued Aug. 8, 2000.

One feature that is common to skim coat-containing heat transfer label assemblies of the type described above is that such assemblies typically include an ink layer sandwiched between a protective lacquer layer and a heat-activatable adhesive layer. The protective lacquer layer is typically present in the assembly to provide scuff and/or chemical resistance to the label, and the adhesive layer is typically present in the assembly to promote bonding of the label to the desired article. One disadvantage, however, to the inclusion of the protective lacquer layer and/or the adhesive layer in such an assembly is that the printing of such layers to form the assembly necessarily results in a reduction in the number of available printing stations for printing the ink design layer. Consequently, the ink design layer may not possess as much detail or variation in color as may be desired. In addition, the inclusion of the protective lacquer layer and/or adhesive layer in the assembly may increase the manufacturing costs for the assembly. Consequently, it would be desirable to omit one or both of the protective lacquer and adhesive layers from a label assembly of the type described above while still retaining in the assembly the protective and adhesive properties of the omitted layers.

It should also be noted that, when using a heat-transfer label assembly of the type described above to decorate an article, one typically, prior to decoration, preheats the label assembly and pre-treats the article to be labeled. For example, where the article to be labeled is made of glass, the glass article is typically pre-treated with a silane adhesion promoter and is then typically preheated to a temperature of about 300° F. For most plastic articles, the plastic article is typically subjected, prior to decoration, to preheating using a heat-gun, a heated chamber or the like and/or is subjected to an oxidizing flame to render the article more chemically receptive to bonding. Decoration is then typically performed by applying heat to the bottom of the carrier while the top of the label is pressed against the article. Once the transferred portion of the heat-transfer label assembly has been applied to the article, the labeled article is then typically subjected to a post-treating step so that the protective lacquer layer and/or the adhesive layer, one or both of which typically comprise thermosetting resins, may be cured. (By contrast, the ink layer of the above-described heat-transfer label assembly does not typically include a thermosetting resin.) Said post-treatment step is typically performed by conveying the labeled articles through one or more industrial ovens to heat the articles to an elevated temperature, such as 400° F., for a particular amount of time, typically 15-20 minutes.

As can readily be appreciated, the above-described pre-treatment and post-treatment steps typically require the use of special equipment or materials and require time and labor to accomplish. Consequently, efforts have been undertaken to eliminate the need for such pre-treatment and/or post-treatment steps.

For example, in U.S. Pat. No. 6,344,269, inventors Makar et al., which issued Feb. 5, 2002, and which is incorporated herein by reference, there is disclosed a heat-transfer label that is said to be well-suited for use on untreated polyethylene, particularly untreated high-density polyethylene and untreated low-density polyethylene. In one embodiment, the label includes a support portion, the support portion comprising a paper carrier web overcoated with a layer of polyethylene. The label also includes a skim coat of wax overcoating the polyethylene-coated paper. The label further comprises a transfer portion printed on top of the wax skim coat, the transfer portion including a protective lacquer layer printed directly on top of at least a portion of the wax skim coat, an ink design layer printed onto a desired area of lacquer layer and a heat-activatable adhesive layer printed onto design layer, any exposed portions of lacquer layer and onto a surrounding portion of skim coat. The protective lacquer layer preferably comprises a release agent and at least one of a hard polyester resin or an acrylic resin. The ink design layer preferably comprises a polyamide ink. The adhesive layer preferably comprises a soft polyamide resin, a chlorinated polyolefin of the type that binds well to polyethylene, an ethylene vinyl acetate resin and an anti-blocking agent preferably in the form of a wax-like amide, such as erucamide.

In addition, in International Publication No. WO 03/061968, which was published Jul. 31, 2003, and which is incorporated herein by reference, there is disclosed a heat-transfer label assembly and method of using the same. The aforementioned assembly, which is said to be adapted for decorating glass articles without requiring post-treatment of the labeled glass articles, comprises, in one embodiment, a paper substrate overcoated with a layer of polyethylene, a skim coat of wax overcoated onto the polyethylene layer, and one or more heat-transfer labels printed onto the skim coat and spaced apart from one another. Each label consists of one or more ink design layers, each ink design layer comprising a binder, a colorant and a cross-linking system, the cross-linking system being adapted to effect complete cross-linking of the binder within about 1-2 minutes after the ink design layer has been transferred to a glass article that has been pre-heated to a temperature of about 250° F.-325° F. The binder comprises one or more resins selected from the group consisting of polyester resins, polyester/vinyl resins, polyamide resins, phenoxy resins, epoxy resins, polyketone resins, and acrylic resins. The binder may further include a vinyl chloride/vinyl acetate resin. The cross-linking system comprises a cross-linking resin for completely cross-linking the binder and a heat-activatable catalyst for catalyzing the cross-linking of the cross-linking resin to the binder. The cross-linker is preferably a partially methylated melamine-formaldehyde resin, and the catalyst is preferably an amine-blocked sulfonic acid catalyst.

Although the heat-transfer label assembly of the aforementioned international publication is desirable (i) in that the transferred label possesses good protective and adhesive properties, without including protective lacquer and adhesive layers, and (ii) in that post-treatment of the labeled article is unnecessary, the present inventor has found that said heat-transfer label assembly is unsuitable for use on most, if not all, flexible plastic articles, and instead, is limited in its application to glass and other inflexible articles since the label, itself, possesses very little flexibility. Consequently, if the aforementioned heat-transfer label assembly is used to label a flexible plastic article and the thus-labeled plastic article is flexed, the transferred label breaks or cracks on the flexible plastic article.

Moreover, whereas the aforementioned label assembly may be used to label glass articles without requiring post-treatment, said label assembly nonetheless still requires that the glass article be pre-treated in the conventional fashion, i.e., by silane treatment followed by pre-heating.

SUMMARY OF THE INVENTION

It is an object of the present invention to provide a novel heat-transfer label assembly.

It is another object of the present invention to provide a heat-transfer label assembly as described above that overcomes at least some of the problems associated with existing heat-transfer label assemblies of the type described above.

In furtherance of the above and other objects to be set forth or to become apparent from the description to follow, and according to one aspect of the invention, there is provided a heat-transfer label assembly, said heat-transfer label assembly comprising (a) a carrier; (b) a wax skim coat deposited onto said carrier; and (c) a heat-transfer label, said heat-transfer label being deposited directly onto said wax skim coat for transfer of said heat-transfer label from said carrier to an article under conditions of heat and pressure, said heat-transfer label being bondable to the article under conditions of heat and pressure and consisting of one or more ink design layers, each of said ink design layers comprising (i) a mixture of polyester resins; (ii) a cross-linking system adapted to effect partial cross-linking of the mixture of polyester resins upon transfer of said heat-transfer label to the article; and (iii) a colorant.

In a preferred embodiment, one or more of said ink design layers is obtained using a formulation consisting of (i) 3-4%, by weight, of a first polyester resin having a tensile strength of about 8000 psi, a 7% elongation, and a Shore D hardness of 79, (ii) 10-13%, by weight, of a second polyester resin having a tensile strength of about 7000 psi, a 4% elongation, and a Shore D hardness of 78, (iii) 8-9%, by weight, of a third polyester resin having a tensile strength of about 30 psi, a >2000% elongation, and a Shore A hardness of 25, (iv) 0.5-1%, by weight, of a hexamethoxymethylmelamine resin, (v) 0.05-0.10%, by weight, of a sulfonic acid catalyst, (vi) 4-5%, by weight, of a non-white pigment, (vii) 14.5-16%, by weight, of methyl ethyl ketone, (viii) 14.8-16.4%, by weight, of n-propyl acetate, (ix) 38.90-41.95%, by weight, of tolune, and (x) 0.05-0.10%, by weight, of isopropanol.

According to another aspect of the invention, there is provided a heat-transfer label assembly, said heat-transfer label assembly comprising (a) a carrier; and (b) a heat-transfer label, said heat-transfer label being deposited directly onto said carrier for transfer of said heat-transfer label from said carrier to an article under conditions of heat and pressure, said heat-transfer label being bondable to the article under conditions of heat and pressure and consisting of one or more ink design layers, each of said ink design layers comprising (i) a mixture of polyester resins; (ii) a cross-linking system adapted to effect partial cross-linking of the mixture of polyester resins upon transfer of said heat-transfer label to the article; and (iii) a colorant; (c) wherein said carrier is made of a non-wax material that separates cleanly from said heat-transfer label with no visually discernible portion of said carrier being transferred to the article along with said heat-transfer label.

The present invention is also directed to a method of labeling an article, said method comprising the steps of (a) providing a heat-transfer label assembly, said heat-transfer label assembly comprising (i) a carrier; (ii) a wax skim coat deposited onto said carrier; and (iii) a heat-transfer label, said heat-transfer label being deposited directly onto said wax skim coat for transfer of said heat-transfer label from said carrier to an article under conditions of heat and pressure, said heat-transfer label being bondable to the article under conditions of heat and pressure and consisting of one or more ink design layers, each of said ink design layers comprising (i) a mixture of polyester resins; (ii) a cross-linking system adapted to effect partial cross-linking of the mixture of polyester resins upon transfer of said heat-transfer label to the article; and (iii) a colorant; and (b) transferring said heat-transfer label from said carrier to said article.

Where the article being labeled is a flexible plastic article, the above-described label is preferably sufficiently flexible to avoid cracking when the flexible plastic article onto which the label has been transferred is flexed.

For purposes of the present specification and claims, it is to be understood that certain terms used herein, such as "on" or "over," when used to denote the relative positions of two or more layers of a heat-transfer label, are primarily used to denote such relative positions in the context of how those layers are situated prior to transfer of the transfer portion of the label to an article since, after transfer, the arrangement of layers is inverted as those layers which were furthest removed from the associated support sheet are now closest to the labeled article.

Additional objects, as well as features, advantages and aspects of the present invention, will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
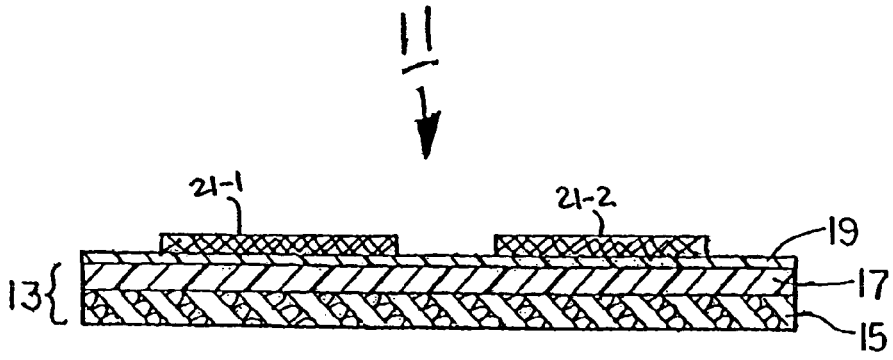
FIG. 1 is a schematic section view of a first embodiment of a heat-transfer label assembly constructed according to the teachings of the present invention.

Referring now to FIG. 1, there is shown a schematic section view of a first embodiment of a heat-transfer label assembly, said heat-transfer label assembly being represented generally by reference numeral 11. As will be further described below, assembly 11 is particularly well-suited for use in decorating flexible plastic articles including, but not limited to, flexible plastic containers made of polyethylene terephthalate (PET), acrylonitrile, polycarbonate, polyvinyl chloride (PVC), polypropylene (PP), polystyrene (PS) and/or polyethylene (PE).

Assembly 11 comprises a carrier 13. Carrier 13, in turn, comprises a substrate 15. Substrate 15 is preferably a paper substrate of the type conventionally used in heat-transfer label assemblies but may alternatively be a polymer-coated paper substrate or a polymer film substrate. Carrier 13 also includes a polyethylene layer 17, polyethylene layer 17 being overcoated onto substrate 15 in the conventional manner. Details of polyethylene layer 17 are disclosed in U.S. Pat. Nos. 4,935,300 and 4,927,709, the disclosures of which are incorporated herein by reference.

Assembly 11 also comprises a wax skim coat 19 of the type conventionally used in skim coat-containing heat-transfer label assemblies, skim coat 19 being coated directly on top of the entirety of polyethylene layer 17. During label transfer, skim coat 19 splits apart or fractures to release the label from carrier 13, with a portion of skim coat 19 typically being transferred along with the label onto the article being decorated, and a portion of skim coat 19 typically remaining on top of polyethylene layer 17.

Assembly 11 further comprises a plurality of spaced-apart heat-transfer labels 21-1 and 21-2 (it being understood that, although two heat-transfer labels 21 are shown in the present embodiment, assembly 11 could be modified to include any number of such labels), heat-transfer labels 21-1 and 21-2 being positioned directly on top of skim coat 19 for transfer of labels 21-1 and 21-2, under appropriate conditions of heat and pressure, from carrier 13 to suitable articles, such as, but not limited to, flexible plastic containers.

Although, in the present embodiment, heat-transfer label 21 is shown as consisting of a single ink design layer printed directly onto skim coat 19, it should be understood that heat-transfer label 21 may consist of a plurality of identical or different ink design layers printed onto skim coat 19 in a multi-layer stack. Each one of said one or more ink design layers is formed by depositing, preferably by gravure printing, an ink composition of the type to be described below and, thereafter, allowing the volatile solvent(s) of the ink composition to evaporate, leaving only the non-volatile components of said ink composition to form the ink design layer.

A first class of ink compositions of the present invention suitable for use in making label 21 comprises (i) a mixture of polyester resins of the type hereinafter described; (ii) a cross-linking system adapted to effect partial cross-linking of the mixture of polyester resins soon after transfer of label 21 to a desired article; (iii) a colorant; and (iv) one or more suitable volatile solvents.

The aforementioned mixture of polyester resins should collectively possess the properties of being: (i) sufficiently tacky that, when assembly 11 is subjected to the conditions of heat and pressure encountered during label transfer, label 21 securely bonds to the article being decorated; and (ii) not so tacky that, prior to label transfer, assembly 11 blocks (i.e., label 21 adheres to the underside of carrier 13 when assembly 11 is wound into a roll).

In addition, the mixture of polyester resins and the cross-linking system should be selected so that, after the resins have been cross-linked, label 21 is endowed with an acceptable degree of scuff and chemical resistance while, at the same time, retaining a sufficient degree of flexibility to avoid cracking when the article onto which the label has been transferred is flexed.

The present inventor has found that the above-described combination of properties may be met (i) by using a mixture of soft and hard polyester resins that collectively possess sufficient tackiness to bond to the article once activated during label transfer while, at the same time, not causing blocking prior to label transfer and (ii) by cross-linking said mixture of polyester resins to an extent sufficient to achieve desirable scuff and chemical resistance while, at the same time, not to an extent that would cause the label to become so inflexible as to crack on a flexed article. It is believed by the present inventor that, to achieve the dual objectives of (i) attaining scuff and chemical resistance and (ii) retaining sufficient flexibility to avoid cracking on flexible articles, the resins should only be partially cross-linked, as opposed to being completely cross-linked. Where a cross-linking resin is used to cross-link the polyester resins, partial cross-linking may be effected by using an excess of polyester resin relative to the amount of cross-linking resin used. Alternatively, partial cross-linking may be achieved by using a mixture of polyester resins in which some, but not all, of the polyester resins are chemically adapted for cross-linking. Depending upon the types of polyester and cross-linking resins used and the type of pigment used, the polyester resins are preferably cross-linked about 10%-80%, with white inks of the type used to form a background applied directly to the flexible article preferably having a smaller percentage of cross-linked polyester resins (preferably about 10-50%) and non-white inks of the type positioned over such a white background preferably having a larger percentage of cross-linked polyester resins (preferably about 50-80%).

An example of a suitable mixture of polyester resins, which mixture is particularly well-suited for use in non-white inks, includes the following mixture of resins combined in an approximately 1:3:2 ratio, by weight: (i) ViTEL® 2300 resin (Bostik Findley, Middleton, Mass.), a copolyester resin having a molecular weight of about 47,500 daltons, a $T_g$ of 63° C., a tensile strength of about 8000 psi, a 7% elongation, a hydroxyl number of 3-5, and a Shore D hardness of 79; (ii) ViTEL® 2700 resin (Bostik Findley, Middleton, Mass.), a copolyester resin having a molecular weight of about 67,000 daltons, a $T_g$ of 47° C., a tensile strength of about 7000 psi, a 4% elongation, a hydroxyl number of 2-5, and a Shore D hardness of 78; and (iii) ViTEL® 3550 resin (Bostik Findley, Middleton, Mass.), a copolyester resin having a molecular weight of about 75,000 daltons, a $T_g$ of −15° C., a tensile strength of about 30 psi, a >2000% elongation, a hydroxyl number of 3-6, and a Shore A hardness of 25, respectively.

Another example of a suitable mixture of polyester resins, which mixture is particularly well-suited for use in white inks, includes the following mixture, which is obtained by combining the following resins in an approximately 3.5:1:3 ratio, by weight: (i) ViTEL® 2300 resin; (ii) ViTEL® 3550 resin (Bostik Findley, Middleton, Mass.); and (iii) ViTEL®3300 resin (Bostik Findley, Middleton, Mass.), a copolyester resin having a molecular weight of about 63,000 daltons, a $T_g$ of 11° C., a tensile strength of about 500 psi, an 800% elongation, a hydroxyl number of 3-6, a Shore A hardness of 72, and a Shore D hardness of 25, respectively.

The cross-linking system of the subject ink composition preferably comprises (i) a cross-linking resin for cross-linking the resinous binder and (ii) a heat-activatable catalyst for catalyzing the cross-linking of the cross-linker to the resinous binder soon after transfer of label 21 to the article (i.e., with cross-linking initiated by heat-transfer and preferably complete by the time the labeled article cools to room temperature). Examples of suitable cross-linking resins include partially methylated melamine-formaldehyde resins of the type present in the CYMEL 300 series of partially methylated melamine-formaldehyde resin solutions (Cytec Industries, Inc., West Paterson, N.J.) and, in particular, CYMEL 303 hexamethoxymethylmelamine resin. Such a cross-linker is preferably present in the ink composition in an amount constituting about 1-4%, by weight, of the total binder. An example of a suitable catalyst is a sulfonic acid catalyst, such as CYCAT 4040® catalyst (Cytec Industries, Inc., West Paterson, N.J.). Such a catalyst is preferably present in the ink composition in an amount constituting about 0.01% to 1%, by weight, of the total composition.

The colorant is a pigment and is preferably present in the ink composition in an amount representing about 20% to 100%, by weight, of the other non-volatile components of the formulation. Where the pigment is titanium dioxide (a white pigment), the relative proportion of colorant to the other non-volatile components is typically much greater than for pigments other than titanium dioxide. This is because, as noted above, white inks are often used to provide an opaque background on the article being decorated whereas non-white inks are often positioned to appear layered on top of said opaque background.

The one or more volatile solvents are typically volatile solvents of the type commonly used in heat-transfer label inks and may include one or more of methyl ethyl ketone (MEK), n-propyl acetate, toluene and isopropanol, said solvents preferably being present in the ink composition in an amount constituting about 40%-75%, by weight, of the total ink composition. The particular proportion of solvent(s) to non-volatile components is typically dependent upon the viscosity requirements for printing, with the objective typically being to maximize the percentage of non-volatiles (and, therefore, viscosity) while still achieving good print quality.

Illustrative examples of the aforementioned first class of ink formulations include the following:

| Example No. 1 (White) | % By Weight |
|---|---|
| ViTEL ® 2300 polyester resin | 14.00 |
| ViTEL ® 3300 polyester resin | 12.50 |
| ViTEL ® 3550 or 3650 polyester resin | 4.00 |
| CYMEL 303 melamine resin | 0.40 |
| CYCAT ® 4040 cross-linking catalyst | 0.04 |
| Titanium dioxide powder | 25.00 |
| Methyl ethyl ketone (MEK) | 14.00 |
| n-propyl acetate | 10.00 |
| Toluene | 19.96 |
| Isopropanol | 0.04 |

| Example No. 2 (Non-white) | % By Weight |
|---|---|
| ViTEL ® 2300 polyester resin | 3.00-4.00 |
| ViTEL ® 2700 polyester resin | 10.00-13.00 |
| ViTEL ® 3550 or 3650 polyester resin | 8.00-9.00 |
| CYMEL 303 melamine resin | 0.50-1.00 |
| CYCAT ® 4040 cross-linking catalyst | 0.05-0.10 |
| Non-white pigment | 4.00-5.50 |
| MEK | 14.50-16.00 |
| n-propyl acetate | 14.80-16.40 |
| Toluene | 38.90-41.95 |
| Isopropanol | 0.05-0.10 |

In contrast with the above-described first class of ink compositions, which ink compositions utilize cross-linking of the polyester resins to endow the label with a desired degree of scuff and chemical resistance, a second class of ink compositions in accordance with the teachings of the present invention does not involve cross-linking the polyester resins. Instead, said second class of ink compositions includes (i) mixtures of polyester resins that inherently endow the ink with the desired bonding, protective and flexibility characteristics; (ii) a colorant; and (iii) one or more suitable volatile solvents. An example of such a mixture of polyester resins, which mixture is particularly well-suited for use in non-white inks, includes the following resins combined in an approximately 1:1:2 ratio, by weight: (i) ViTEL® 2300 resin; (ii) ViTEL® 2700 resin; and (iii) ViTEL® 5833 resin (Bostik Findley, Middleton, Mass.), a low molecular weight (i.e., about 9800 daltons), brittle polymer having a $T_g$ of 48° C. and a hydroxyl number of 35-41, respectively.

Another example of a suitable mixture of polyester resins, which mixture is particularly well-suited for use in white inks, includes the following mixture, which is obtained by combining the following resins in an approximately 2:1:1 ratio, by weight: (i) ViTEL® 2300 resin; (ii) ViTEL® 3300 resin; and (iii) ViTEL® 5833 resin (Bostik Findley, Middleton, Mass.), respectively.

The colorant of such ink compositions is a pigment and is preferably present in the ink composition in an amount representing about 10% to 100%, by weight, of the other non-volatile components of the formulation. For the same reasons discussed above in connection with the first class of ink compositions, where the pigment is titanium dioxide (a white pigment), the relative proportion of colorant to the other non-volatile components is typically much greater than for pigments other than titanium dioxide.

The one or more volatile solvents of such an ink composition are typically volatile solvents of the type commonly used in heat-transfer label inks and may include one or more of methyl ethyl ketone (MEK), n-propyl acetate, and toluene, said solvents preferably being present in the ink composition in an amount constituting about 40%-75%, by weight, of the total ink composition. The particular proportion of solvent(s) to non-volatile components is typically dependent upon the viscosity requirements for printing, with the objective typically being to maximize the percentage of non-volatiles (and, therefore, viscosity) while still achieving good print quality.

Illustrative examples of said second class of ink formulations include the following:

| Example No. 3 (White) | % By Weight |
|---|---|
| ViTEL ® 2300 polyester resin | 12.07 |
| ViTEL ® 3300 polyester resin | 5.52 |
| ViTEL ® 5833 polyester resin | 6.47 |
| Titanium dioxide powder | 24.14 |
| MEK | 27.67 |
| n-propyl acetate | 9.65 |
| Toluene | 14.48 |

| Example No. 4 (Non-white) | % By Weight |
|---|---|
| ViTEL ® 2300 polyester resin | 5.54-7.83 |
| ViTEL ® 2700 polyester resin | 9.45-13.35 |
| ViTEL ® 5833 polyester resin | 4.72-6.67 |
| Non-white pigment | 3.68-5.20 |
| MEK | 32.42-37.24 |
| n-propyl acetate | 13.13-15.75 |
| Toluene | 21.40-23.62 |

Assembly 11 is particularly well-suited for use in decorating flexible plastic articles, such as flexible plastic containers, made of, for example, polyethylene terephthalate (PET), polyvinyl chloride (PVC), polypropylene (PP), polystyrene (PS), polyethylene (PE), polycarbonate or acrylonitrile. (Assembly 11 may also be used to decorate glass and other inflexible articles.)

The decoration of an article using assembly 11 may be performed using conventional heat-transfer machinery (e.g., conventional preheating unit for preheating the label assembly to about 125° F.-200° F. and conventional turret assembly for applying label to article from carrier web, said turret assembly including a rubber roll and a platen heated to about 325° F.-450° F.). The carrier web typically experiences a temperature of about 250° F.-350° F. at the point of application, depending on the speed of application. In the case of those ink formulations that involve cross-linking, such cross-linking is initiated at the time of label transfer and is preferably complete by the time the label cools to room temperature.

Where assembly 11 is used and the flexible plastic article is made of polyethylene terephthalate (PET), polystyrene (PS), polycarbonate, or acrylonitrile, no pre-treatment of the flexible plastic article or post-treatment of the labeled article is required. Where assembly 11 is used and the flexible plastic article is made of polyvinyl chloride (PVC), no pre-treatment of the flexible plastic article is required; however, it is preferable to post-treat the labeled article in the conventional fashion. Where assembly 11 is used and the flexible plastic article is polypropylene (PP) or polyethylene (PE), both pre-treatment of the flexible plastic article in the conventional manner and post-treatment of the labeled article in the conventional manner are preferred.

As can readily be appreciated, one advantage of assembly 11, as compared to many conventional heat-transfer label assemblies of the skim-coat containing variety, is that no adhesive or protective lacquer layers are included in the assembly. Consequently, the material costs for such adhesive and protective lacquer layers may be avoided, the problem of hazing often exacerbated by the presence of the protective lacquer layer is eliminated, and additional printing stations may be dedicated to forming the ink design layer.

Another advantage of assembly 11 is that, with respect to certain types of flexible plastic articles, such as polyethylene terephthalate, polyvinyl chloride, polcarbonate, polystyrene, and acrylonitrile, no pre-treatment of the article to be labeled is required. Moreover, with respect to polyethylene terephthalate, polycarbonate, polystyrene, and acrylonitrile articles, no post-treatment of the labeled article is required as well. The elimination of the pre-treatment and/or post-treatment steps represents a considerable savings of time, equipment, labor and cost.

Figure 2:
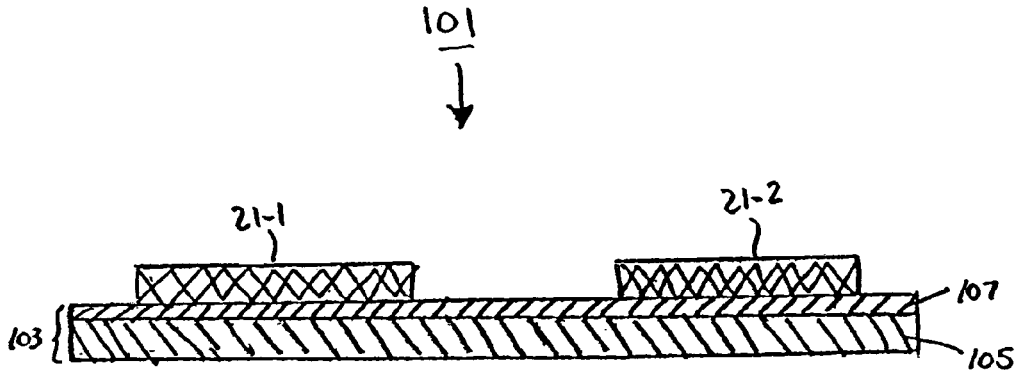
FIG. 2 is a schematic section view of a second embodiment of a heat-transfer label assembly constructed according to the teachings of the present invention.

Referring now to FIG. 2, there is shown a schematic section view of a second embodiment of a heat-transfer label assembly constructed according to the teachings of the present invention, said heat-transfer label assembly being represented generally by reference numeral 101.

Assembly 101 is similar in many respects to assembly 11, the principal difference between the two assemblies being that assembly 101 comprises a carrier 103, instead of carrier 13, and does not comprise a skim coat 19. Carrier 103 comprises a polymeric substrate 105 and a release coating 107 deposited on top of polymeric substrate 105. Substrate 105 is preferably a polymeric film selected from the group consisting of polyesters, such as polyethylene terephthalate, polyethylene napthylene; polyolefins, such as polyethylene and polypropylene; and polyamides.

More preferably, substrate 105 is a clear plastic film of the type described above. As can readily be appreciated, one benefit to using a clear material as substrate 105 is that, if desired, one can inspect the quality of the printed matter of the label by looking at said printed matter through substrate 105 (from which perspective said printed matter appears as it will on the labeled article), as opposed to looking at said printed matter through the adhesive layer of the label (from which perspective said printed matter appears as the mirror image of what will appear on the labeled article).

A particularly preferred plastic material for use as substrate 105 is a clear polyester film, such as a clear polyethylene terephthalate (PET) film. This is because, at least as compared to some other plastic materials like polyethylene and polypropylene, polyester is a strong plastic material and makes a good substrate to be printed onto. In addition, unlike polyethylene, polyester does not tend to soften and become tacky at the types of temperatures typically encountered during heat-transfer. Typically, substrate 105 has a thickness of about 1-2 mil.

Coating 107 is preferably applied directly on top of substrate 105. Coating 107 is a thermoset release material that separates cleanly from label 21 and is not transferred, to any visually discernible degree, with label 21 onto an article being labeled. (For purposes of the present specification and claims, the term "visually discernible" is to be construed in terms of an unaided or naked human eye.) Preferably, release coating 107 is clear for the same types of reasons given above in connection with substrate 105.

Coating 107 does not contain any waxes or any silicones, except to the limited extent provided below, and the terms "non-wax" and "non-silicone," when used in the present specification and claims to describe and to define the present release layer or coating, are defined herein to exclude from said release layer or coating the presence of any and all waxes and silicones not encompassed by the limited exceptions provided below or described in published PCT Application No. WO 01/03950, published Jan. 18, 2001, the disclosure of which is incorporated herein by reference.

Coating 107 preferably has a thickness of about 0.01 to 10 microns, more preferably about 0.02 to 1 micron, even more preferably about 0.1 micron. In addition, coating 107 preferably has a total surface energy of about 25 to 35 mN/m (preferably about 30 mN/m), of which about 0.1 to 4 mN/m (preferably about 1.3 mN/m) is polar surface energy. Furthermore, when analyzed by XPS (X-ray photoelectron spectroscopy), coating 107 preferably has a carbon content (by atomic %) of about 90 to 99.9% (preferably about 97%) and an oxygen content (by atomic %) of about 0.1 to 10% (preferably about 3%). Accordingly, coating 107 is predominantly a hydrocarbon in its chemical makeup.

An example of a coated polymer film suitable for use as carrier 103 of the present invention is available from DuPont Corp. (Wilmington, Del.) as product number 140AXM 701 (140 gauge coated polyester film). Other coated polymer films which may be used as carrier 103 are described in European Patent Application No. 819,726, published Jan. 21, 1998, which document is incorporated herein by reference. The aforementioned European patent application teaches a coated film structure preferably comprising:

(i) polymers selected from the group consisting of polyesters such as polyethylene terephthalate, polyethylene napthylene; polyolefins such as polyethylene and polypropylene; and polyamides; wherein said polymers form a polymeric film surface; and (ii) a primer coating comprising:

(A) functionalized α-olefin containing copolymers, preferably acid functionalized α-olefin containing copolymers, selected from the group consisting of ethylene/acrylic acid copolymers; ethylene/methacrylic acid copolymers; ethylene/vinylacetate/acrylic acid terpolymers; ethylene/methacrylamide copolymers; ethylene/glycidyl methacrylate copolymers; ethylene/dimethylaminoethyl methacrylate copolymers; ethylene/2-hydroxyethyl acrylate copolymers; propylene/acrylic acid copolymers; etc. and (B) crosslinking agents selected from the group consisting of amino formaldehyde resins, polyvalent metal salts, isocyanates, blocked isocyanates, epoxy resins and polyfunctional aziridines;

(iii) wherein said primer coating is applied as a primer to the polymeric film surface, preferably in its amorphous or semi-oriented state and reacted with newly generated polymeric film surfaces formed during uniaxial or biaxial stretching and heat setting.

Although the above-described polymeric film surface is preferably formed of a polyester, a polyolefin, or a polyamide, it may be formed from any material capable of being formed into a sheet or film. The polymeric film surface should be capable of binding or reacting with an acid-functionalized α-olefin copolymer to form a modified film base.

The above-mentioned polymer films can be manufactured by an extrusion process, such as a cast film or blown film process. In a cast film process, the polymer resin is first heated to a molten state and then extruded through a wide slot die in the form of an amorphous sheet. The sheet-like extrudate is rapidly cooled or "quenched" to form a cast sheet of polyester by contacting and traveling partially around a polished, revolving casting drum. Alternatively, the extrudate can be blown in a conventional blown film process. Regardless of the process, however, the polyester sheet is preferably uniaxially or biaxially (preferably biaxially) stretched in the direction of film travel (machine direction) and/or perpendicular to the machine direction (traverse direction), while being heated to a temperature in the range of from about 80° C. to 160° C., preferably about 90° C. to 110° C., the degree of stretching may range from 3.0 to 5.0 times the original cast sheet unit dimension, preferably from about 3.2 to about 4.2 times the original cast sheet dimension. Reaction with the newly generated polymer film surfaces formed during stretching preferably occurs at temperatures about 130° C. or higher.

Additives such as coating aids, wetting aids such as surfactants (including silicone surfactants), slip additives, antistatic agents can be incorporated into the primer coating in levels from 0 to 50% based on the total weight of additive-free coating solids.

In another embodiment (not shown), a paper substrate, such as paper substrate 15, is applied to the bottom of carrier 103.

Figure 3:
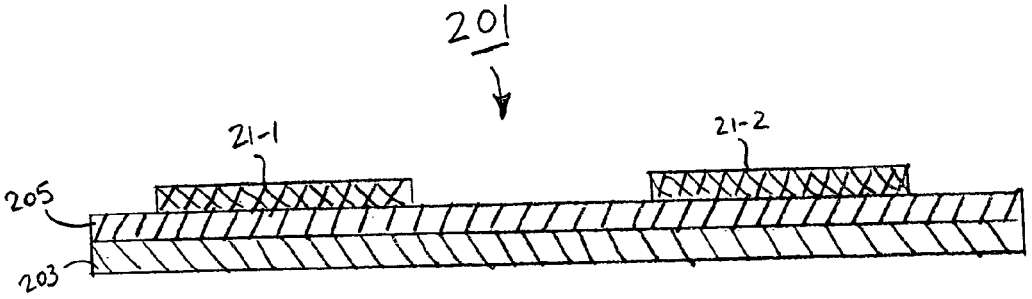
FIG. 3 is a schematic section view of a third embodiment of a heat-transfer label assembly constructed according to the teachings of the present invention.

Referring now to FIG. 3, there is shown a schematic section view of a third embodiment of a heat-transfer label assembly constructed according to the teachings of the present invention, said heat-transfer label assembly being represented generally by reference numeral 201.

Assembly 201 is similar in many respects to assembly 11, the principal difference between the two assemblies being that assembly 201 comprises, instead of carrier 13 and skim coat 19, a carrier 203 and a wax release layer 205. Carrier 203 is preferably in the form of a paper substrate. Wax release layer 205 may be of the type described in U.S. Pat. No. 3,616,015.

The embodiments of the present invention recited herein are intended to be merely exemplary and those skilled in the art will be able to make numerous variations and modifications to it without departing from the spirit of the present invention. For example, it should be appreciated that one may add, either directly or through trans-layer migration, trace or non-functional minor amounts of waxes or silicones to the release layer described herein as "non-wax" and "non-silicone" without being outside the scope of applicants' invention. Thus, the terms "non-wax" and "non-silicone" as used herein is intended to embrace this possibility. All such variations and modifications are intended to be within the scope of the present invention as defined by the claims appended hereto.

What is claimed is:

1. A heat-transfer label assembly, said heat-transfer label assembly comprising:

(a) a substrate;

(b) a release positioned over said substrate; and (c) a heat-transfer label, said heat-transfer label being deposited directly onto said release for transfer of said heat-transfer label from said substrate to an article under conditions of heat and pressure, said heat-transfer label being bondable to the article under conditions of heat and pressure and consisting of one or more ink design layers, each of said ink design layers comprising (i) a mixture of polyester resins, wherein said mixture of polyester resins comprises a first polyester resin having a molecular weight of about 47,500 daltons, a $T_g$ of 63° C., a tensile strength of about 8000 psi, a 7% elongation, a hydroxyl number of 3-5, and a Shore D hardness of 79, a second polyester resin having a molecular weight of about 67,000 daltons, a $T_g$ of 47° C., a tensile strength of about 7000 psi, a 4% elongation, a hydroxyl number of 2-5, and a Shore D hardness of 78, and a third polyester resin having a molecular weight of about 75,000 daltons, a $T_g$ of −15° C., a tensile strength of about 30 psi, a >2000% elongation, a hydroxyl number of 3-6, and a Shore A hardness of 25; (ii) a cross-linking system adapted to effect partial cross-linking of the mixture of polyester resins upon transfer of said heat-transfer label to the article; and (iii) a colorant.

2. The heat-transfer label assembly as claimed in claim 1 wherein said first, second and third polyester resins are combined in an approximately 1:3:2 ratio, by weight, respectively.

3. The heat-transfer label assembly as claimed in claim 2 wherein said cross-linking system is adapted to effect a 50%-80% crosslinking of said mixture of polyester resins.

4. The heat-transfer label assembly as claimed in claim 3 wherein said cross-linking system comprises a cross-linker and a heat-activatable catalyst.

5. The heat-transfer label assembly as claimed in claim 4 wherein said cross-linker is a melamine resin.

6. The heat-transfer label assembly as claimed in claim 5 wherein said melamine resin is a hexamethoxymethylmelamine resin.

7. The heat-transfer label assembly as claimed in claim 4 wherein said heat-activatable catalyst is a sulfonic acid catalyst.

8. The heat-transfer label assembly as claimed in claim 1 wherein at least one of said one or more layers of said heat-transfer label is prepared using a composition consisting of (i) about 3-4%, by weight, of said first polyester resin, (ii) about 10-13%, by weight, of said second polyester resin, (iii) about 8-9%, by weight, of said third polyester resin, (iv) about 0.5-1%, by weight, of a hexamethoxymethylmelamine resin, (v) about 0.05-0.10%, by weight, of a sulfonic acid catalyst, (vi) about 4-5%, by weight, of a non-white pigment, (vii) about 14.5-16%, by weight, of methyl ethyl ketone, (viii) about 14.8-16.4%, by weight, of n-propyl acetate, (ix) about 38.90-41.95%, by weight, of toluene, and (x) about 0.05-0.10%, by weight, of isopropanol.

9. A heat-transfer label assembly, said heat-transfer label assembly comprising:

(a) a substrate;

(b) a release positioned over said substrate; and (c) a heat-transfer label, said heat-transfer label being deposited directly onto said release for transfer of said heat-transfer label from said substrate to an article under conditions of heat and pressure, said heat-transfer label being bondable to the article under conditions of heat and pressure and consisting of one or more ink design layers, each of said ink design layers comprising (i) a mixture of polyester resins, wherein said mixture of polyester resins comprises a first polyester resin having a molecular weight of about 47,500 daltons, a $T_g$ of 63° C., a tensile strength of about 8000 psi, a 7% elongation, a hydroxyl number of 3-5, and a Shore D hardness of 79, a second polyester resin having a molecular weight of about 75,000 daltons, a $T_g$ of −15° C., a tensile strength of about 30 psi, a >2000% elongation, a hydroxyl number of 3-6, and a Shore A hardness of 25, and a third polyester resin having a molecular weight of about 63,000 daltons, a $T_g$ of 11° C., a tensile strength of about 500 psi, a 800% elongation, a hydroxyl number of 3-6, a Shore A hardness of 72, and a Shore D hardness of 25; (ii) a cross-linking system adapted to effect partial cross-linking of the mixture of polyester resins upon transfer of said heat-transfer label to the article; and (iii) a colorant.

10. The heat-transfer label assembly as claimed in claim 9 wherein said first, second and third polyester resins are combined in an approximately 3.5:1:3 ratio, by weight, respectively.

11. The heat-transfer label assembly as claimed in claim 10 wherein said cross-linking system is adapted to effect a 10%-50% crosslinking of said mixture of polyester resins.

12. The heat-transfer label assembly as claimed in claim 11 wherein said cross-linking system comprises a cross-linker and a heat-activatable catalyst.

13. The heat-transfer label assembly as claimed in claim 12 wherein said cross-linker is a melamine resin.

14. The heat-transfer label assembly as claimed in claim 13 wherein said melamine resin is a hexamethoxymethylmelamine resin.

15. The heat-transfer label assembly as claimed in claim 14 wherein said heat-activatable catalyst is a sulfonic acid catalyst.

16. The heat-transfer label assembly as claimed in claim 9 wherein at least one of said one or more layers of said heat-transfer label is prepared using a composition consisting of (i) about 14%, by weight, of said first polyester resin, (ii) about 4%, by weight, of said second polyester resin, (iii) about 12.5%, by weight, of said third polyester resin, (iv) about 0.4%, by weight, of a hexamethoxymethylmelamine resin, (v) about 0.04%, by weight, of a sulfonic acid catalyst, (vi) about 25%, by weight, of titanium dioxide powder, (vii) about 14%, by weight, of methyl ethyl ketone, (viii) about 10%, by weight, of n-propyl acetate, (ix) about 19.96%, by weight, of toluene, and (x) about 0.04%, by weight, of isopropanol.

17. A heat-transfer label assembly, said heat-transfer label assembly comprising:

(a) a substrate;

(b) a release positioned over said substrate; and (c) a heat-transfer label, said heat-transfer label being deposited directly onto said release for transfer of said heat-transfer label from said substrate to an article under conditions of heat and pressure, said heat-transfer label being bondable to the article under conditions of heat and pressure and consisting of one or more ink design layers, each of said ink design layers comprising (i) a mixture of polyester resins, said mixture of polyester resins comprising a first polyester resin having a molecular weight of about 47,500 daltons, a $T_g$ of 63° C., a tensile strength of about 8000 psi, a 7% elongation, a hydroxyl number of 3-5, and a Shore D hardness of 79, a second polyester resin having a molecular weight of about 67,000 daltons, a $T_g$ of 47° C., a tensile strength of about 7000 psi, a 4% elongation, a hydroxyl number of 2-5, and a Shore D hardness of 78, and a third polyester resin, said third polyester resin being a brittle polymer having a molecular weight of about 9800 daltons, a $T_g$ of 48° C. and a hydoxyl number of 35-41, said first, second and third polyester resins being combined in an approximately 1:1:2, ratio, respectively; and (ii) a colorant.

18. The heat-transfer label assembly as claimed in claim 17 wherein said colorant is a non-white colorant.

19. The heat-transfer label assembly as claimed in claim 18 wherein at least one of said one or more layers of said heat-transfer label is prepared using a composition consisting of (i) about 5.54-7.83%, by weight, of said first polyester resin; (ii) about 9.45-13.35%, by weight, of said second polyester resin; (iii) about 4.72-6.67%, by weight, of said third polyester resin; (iv) about 3.68-5.20%, by weight, of said colorant; (v) about 32.42-37.24%, by weight, of methyl ethyl ketone; (vi) about 13.13-15.75%, by weight, of n-propyl acetate; (vii) about 21.40-23.62%, by weight, of toluene.

20. The heat-transfer label assembly as claimed in claim 17 wherein said substrate is polyethylene-coated paper and wherein said release is a wax skim coat positioned directly on top of said polyethylene-coated paper.

21. The heat-transfer label assembly as claimed in claim 17 wherein said substrate is a polymeric film and wherein said release is a non-wax release coating positioned directly on top of said polymeric film.

22. The heat-transfer label assembly as claimed in claim 17 wherein said substrate is a paper substrate and wherein said release is a wax release layer positioned directly on top of said paper substrate.

23. A heat-transfer label assembly, said heat-transfer label assembly comprising:

(a) a carrier;

(b) a wax skim coat deposited onto said carrier; and (c) a heat-transfer label, said heat-transfer label being deposited directly onto said wax skim coat for transfer of said heat-transfer label from said carrier to an article under conditions of heat and pressure, said heat-transfer label being bondable to the article under conditions of heat and pressure and consisting of one or more ink design layers, each of said ink design layers comprising (i) a mixture of polyester resins, said mixture of polyester resins comprising a first polyester resin having a molecular weight of about 47,500 daltons, a $T_g$ of 63° C., a tensile strength of about 8000 psi, a 7% elongation, a hydroxyl number of 3-5, and a Shore D hardness of 79, a second polyester resin having a molecular weight of about 63,000 daltons, a $T_g$ of 11° C., a tensile strength of about 500 psi, an 800% elongation, a hydroxyl number of 3-6, a Shore A hardness of 72, and a Shore D hardness of 25, and a third polyester resin, said third polyester resin being a brittle polymer having a molecular weight of about 9800 daltons, a $T_g$ of 48° C. and a hydoxyl number of 35-41, said first, second and third polyester resins being combined in an approximately 2:1:1, ratio, respectively; and (ii) a colorant.

24. The heat-transfer label assembly as claimed in claim 23 wherein said colorant is a white colorant.

25. The heat-transfer label assembly as claimed in claim 23 wherein at least one of said one or more layers of said heat-transfer label is prepared using a composition consisting of (i) about 12.07%, by weight, of said first polyester resin; (ii) about 5.52%, by weight, of said second polyester resin; (iii) about 6.47%, by weight, of said third polyester resin; (iv) about 24.14%, by weight, of titanium dioxide powder; (v) about 27.67%, by weight, of methyl ethyl ketone; (vi) about 9.65%, by weight, of n-propyl acetate; (vii) about 14.48%, by weight, of toluene.

26. The heat-transfer label assembly as claimed in claim 23 wherein said substrate is polyethylene-coated paper and wherein said release is a wax skim coat positioned directly on top of said polyethylene-coated paper.

27. The heat-transfer label assembly as claimed in claim 23 wherein said substrate is a polymeric film and wherein said release is a non-wax release coating positioned directly on top of said polymeric film.

28. The heat-transfer label assembly as claimed in claim 23 wherein said substrate is a paper substrate and wherein said release is a wax release layer positioned directly on top of said paper substrate.

* * * * *

UNITED STATES PATENT AND TRADEMARK OFFICE

CERTIFICATE OF CORRECTION

PATENT NO. : 7,364,777 B1
APPLICATION NO. : 10/920523
DATED : April 29, 2008
INVENTOR(S) : Saifudin M. Ansari It is certified that error appears in the above-identified patent and that said Letters Patent is hereby corrected as shown below:

Column 5,
Line approx. 27, "of tolune," should be -- of toluene, --.

Column 14,
Line 2, "is intended" should be -- are intended --.

Column 16,
Line 15 (Claim 17), "1:1:2, ratio," should be -- 1:1:2 ratio --.

Column 17,
Line 1 (Claim 23), "1:1:2, ratio," should be -- 1:1:2 ratio --.

Signed and Sealed this

Twenty-eighth Day of April, 2009

John Doll

JOHN DOLL
*Acting Director of the United States Patent and Trademark Office*